US006152783A

United States Patent [19]

Tsuchiya

[11] Patent Number: 6,152,783

[45] Date of Patent: Nov. 28, 2000

[54] DOUBLE LOCKING MEMBER FOR A CONNECTOR

[75] Inventor: Shinichi Tsuchiya, Shizuoka, Japan

[73] Assignee: Yazaki Corporation, Tokyo, Japan

[21] Appl. No.: 09/100,959

[22] Filed: Jun. 22, 1998

[30] Foreign Application Priority Data

Jun. 20, 1997 [JP] Japan ..... 9-164414

[51] Int. Cl.[7] ..... H01R 13/514

[52] U.S. Cl. ..... 439/752

[58] Field of Search ..... 439/752

[56] References Cited

U.S. PATENT DOCUMENTS

| | | | |
|---|---|---|---|
| 5,299,958 | 4/1994 | Ohsumi | 439/752 |
| 5,478,262 | 12/1995 | Yamanashi et al. | 439/752 |
| 5,490,802 | 2/1996 | Plyler et al. | 439/752 |
| 5,839,923 | 11/1998 | Yoshida | 439/752 |

FOREIGN PATENT DOCUMENTS 3-97875 10/1991 Japan .

*Primary Examiner*—Paula Bradley
*Assistant Examiner*—Katrina Davis
*Attorney, Agent, or Firm*—Sughrue, Mion, Zinn, Macpeak & Seas, PLLC

[57] ABSTRACT

A double locking member for a connector which will not be inadvertently unlocked by an external force and which upon repeated engagement and disengagement thereof, the locking members are not damaged. The double locking member is inserted into inserting holes (4) formed in a side board (3) of a housing (2) and the side walls (23) of terminal accommodating chambers, and includes flexible arms (13) having locking protrusions (12) which are formed by cuts (11) in the rear end portions thereof, and terminal supporting pieces (14) which have a hook (15) at their ends which is abutted against the side board (3) of the housing (2). Recesses (5) are formed around the inserting holes (4) formed in the side boards (3) of the housing (2), a locking rib (6) is protruded from the recess (5), and a locking hole (16) which is locked to the locking rib (6) is formed in the hook (15).

11 Claims, 5 Drawing Sheets

DOUBLE LOCKING MEMBER FOR A CONNECTOR

BACKGROUND OF THE INVENTION

1. Field of the Invention

This invention relates to a double locking member for a connector, and more particularly to a structure which secondarily locks terminals in terminal accommodating chambers of a connector housing.

2. Related Art

A variety of techniques for secondarily locking terminals in a connector housing are known. FIGS. 5 and 6 show a conventional double locking member for a connector which is disclosed in Japanese Utility Patent Application (OPI) No. 97875/1991 (the term "OPI" as used herein means an "unexamined published application").

In FIG. 5, reference numeral 41 designates a connector; and 43, a plurality of terminal accommodating chambers having inlets 44. The connector 41 includes a housing 42 made of synthetic resin and having terminal accommodating chambers in which connecting terminals 36 and 37 are insertable through the inlets 44. The terminals are fixed in the terminal accommodating chambers 43.

Each of the connecting terminals 36 and 37 is formed by blanking a metal plate. The front end portion of each terminal is a contact portion 38 into which a mating pin contact (not shown) is insertable so that the pin contact is electrically connected to the terminal, and the rear end portion of each terminal is a crimping portion 39 which fixedly crimps a covered wire and its conductor. A guide protrusion 40 is formed on a part of the upper surface of the contact portion 38.

In the housing 42, the terminal accommodating chambers 43 are defined by top walls 45 and side walls 46. The top walls have guide grooves 47 and 48 extending end to end for guiding the connecting terminals 36 and 37. The guide grooves 47 and 48 are so arranged to ensure that the terminals are connected to the predetermined pin contacts.

In order to prevent the connecting terminals 36 and 37 from being inadvertently removed from the terminal accommodating chambers 43 in the rearward direction, as shown in FIG. 6, first locking members, namely, locking lances 49, are provided integral with the housing 42 and extend from the rear surfaces of the top walls 45 of the housing 42 obliquely forwardly in the terminal accommodating chambers 43. Therefore, the locking lances 49 abut the rear ends of the contact portions 38 of the connecting terminals 36 and 37 to retain the terminals. In addition, reference numeral 50 designates a suitable number of second locking members formed of an insulating material, namely, double locking members; and 52, a suitable number of inserting holes formed in the side walls 46 of the housing, extending from the side boards 51 of the housing 42 in a direction perpendicular to the longitudinal axes of the terminal accommodating chambers 43. The double locking members 50 are insertable into the inserting holes thus formed. The front end faces of the double locking member 50 are locking faces 53, which abut the rear ends of the guiding protrusions 40.

The above-described double locking members are elongated, and their first ends 50 are integrally connected to an end plate 54. A means for locking the double locking members 50 to the housing 42 may be designed as indicated by the double-dot chain line in FIG. 5. That is, the end plate 54 maybe locked with a hook-shaped flexible locking board 55 which is integral with the housing 42.

Another means for locking the double locking members is as shown in FIG. 7. That is, locking protrusions 56 are formed on the rear end faces of the double locking members 50. The locking protrusions 56 thus formed are locked to the side walls 46.

However, the above-described conventional double locking members suffer from the following difficulties. That is, in the case where the end board 54 is locked with the hook-shaped locking board 55 (see FIG. 5), the following difficulties are experienced. Since the locking board 55 protrudes from the side board 51 of the housing 2, the connector itself is unavoidably bulky. Further, the locking board 55 may be bent or broken by an external force attributable to the collision of some other member therewith, so that the double locking member may become disengaged.

In the case where the locking protrusions 56 are formed on the rear end faces of the double locking members 50, and the locking protrusion 56 thus formed are engaged with the side walls 46 (see FIG. 7), the locking protrusions 56 are forcibly engaged with the side walls. Hence, it is difficult to disengage the locking protrusions 56 from the side walls. Further, as the engagement and disengagement of the locking protrusions are repeatedly carried out, the locking protrusion 56 and the side walls 46 may be broken.

In view of the foregoing, an object of the invention is to provide a double locking member for a connector which will not be inadvertently unlocked by an external force, which is free from a difficulty that, even when the engagement and disengagement thereof are repeatedly carried out, the relevant members are not damaged, and which is not bulky.

SUMMARY OF THE INVENTION

The foregoing object of the invention has been achieved by the provision of a double locking member for secondarily retaining terminals in terminal accommodating chambers of a connector housing upon insertion of the double locking member in insertion holes formed in the housing. The double locking member comprises: a pair of locking prongs extending parallel to each other, the locking prongs including flexible arms having locking protrusions extending outwardly therefrom and terminal retaining pieces, respectively; and a hook member connected to the terminal retaining pieces, the hook member being engageable with the housing to retain the double locking member to the housing in a condition where the terminals are respectively retained by the terminal retaining pieces in the terminal accommodating chambers.

According to another aspect of the invention, a side wall of the housing in which the insertion holes are formed includes a recess which circumscribe the insertion holes to form countersinks in which the hook member is received such that the hook member does not protrude from the housing.

Further, the double locking member further comprises a locking rib which extends from the housing and is engageable with a retaining hole formed in the hook member. According to yet another aspect of the invention, the insertion holes extend perpendicular to the terminal accommodating chambers.

Based on the foregoing, the double locking members are positively secured to the housing or removed from the latter. Further, even if the locking and the removing of the double locking members are repeatedly performed, the relevant members will never be damaged.

Further, with the retaining hole engaged by the locking rib, the terminal supporting piece having the hook member is positively secured to the housing, and even when the connecting terminal is pulled outwardly, the connecting terminal is positively fixedly held in the terminal accommodating chamber. Since the hook member does not protrude from the recess formed around the inserting holes, the double locking member is free from the difficulty that the locking state of the double locking members is eliminated by external force.

Furthermore, in the double locking member, the inserting holes extend through the side board of the housing and the side walls, and the recess and the locking rib are provided around both the openings of the inserting holes. Therefore, even if an obstacle is near one side board of the housing, the double locking members can be inserted into the housing through the openings of the other (opposite) side board of the housing.

DETAILED DESCRIPTION OF THE INVENTION

A double locking member for a connector, which constitutes a preferred embodiment of the invention, will be described with reference to the accompanying drawings in detail.

Figure 1:
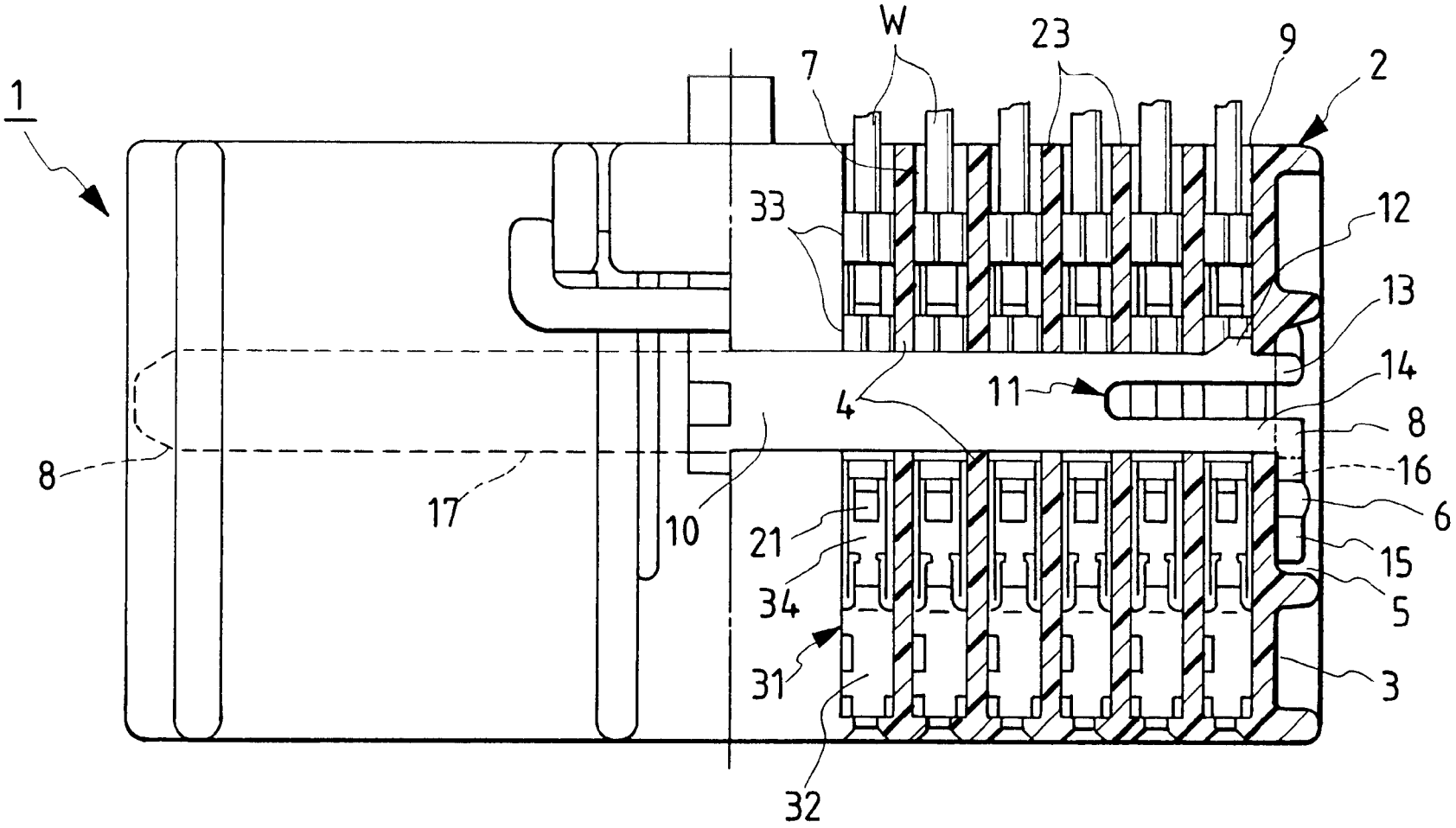
FIG. 1 is a horizontal sectional view of a double locking member for a connector, which constitutes a preferred embodiment of the invention.
Figure 2:
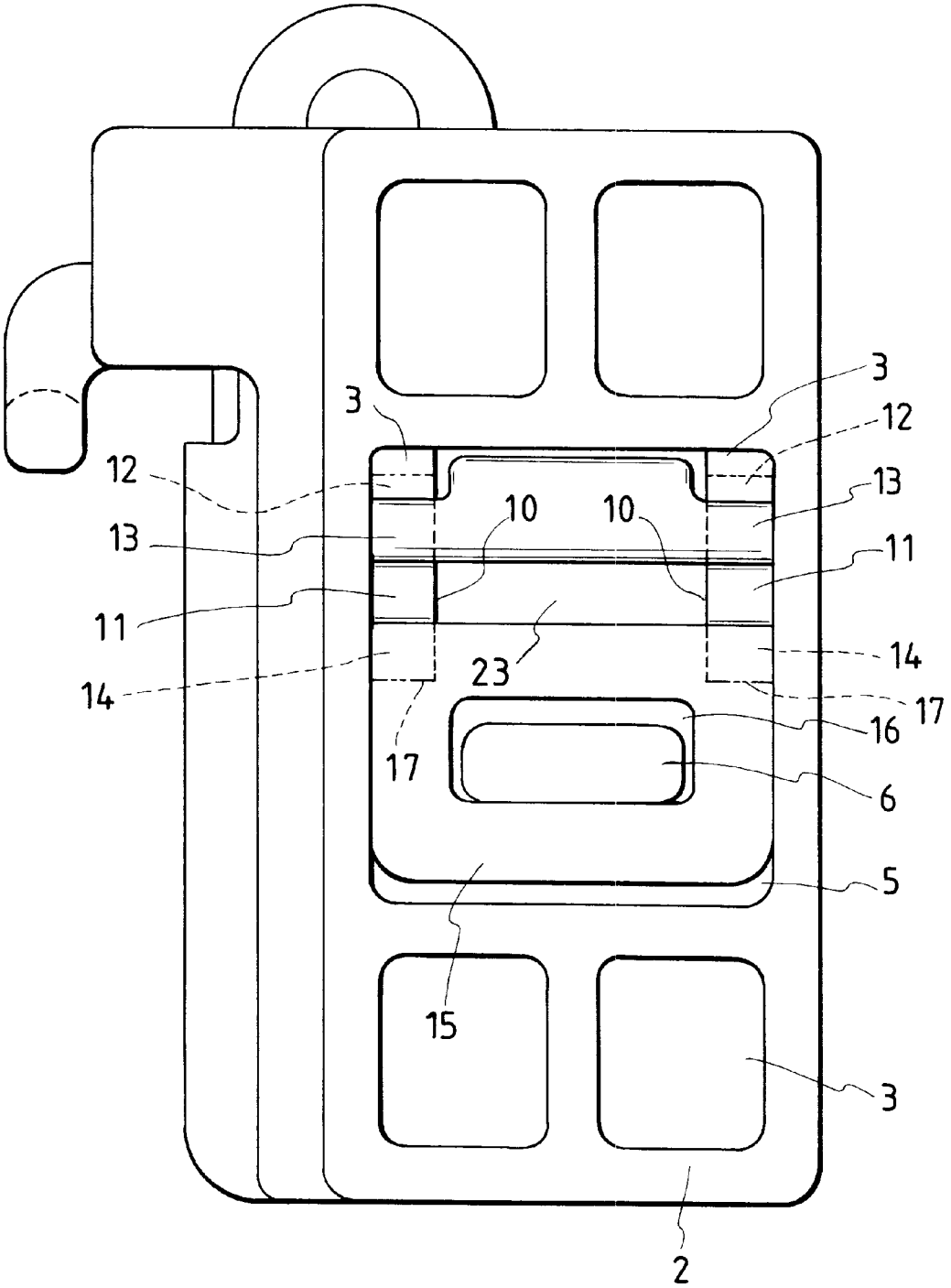
FIG. 2 is a side view of the double locking member in FIG. 1.
Figure 3:
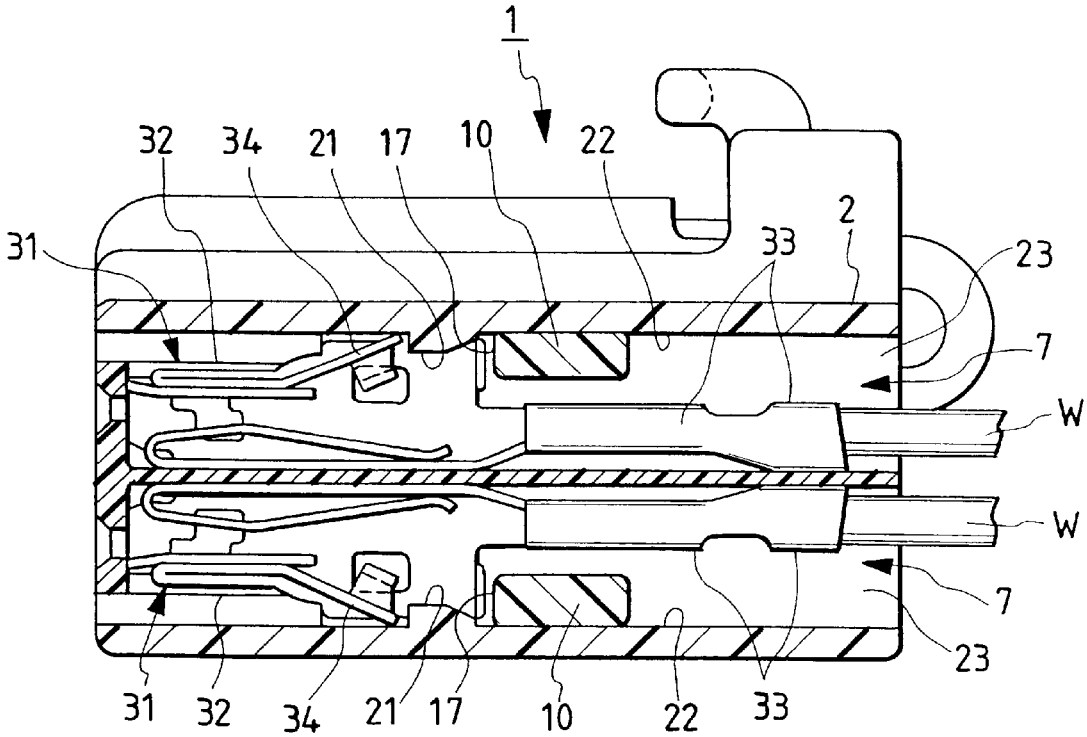
FIG. 3 is a vertical sectional view taken along an axis of a terminal accommodating chamber in FIG. 1.

FIG. 1 is a horizontal sectional view of a connector, showing a double locking member; FIG. 2 is a side view of the double locking member of FIG. 1 as viewed from the hook portion side; FIG. 3 is a vertical sectional view of a terminal accommodating chamber shown in FIG. 1; and FIG. 4 is a perspective view of the double locking members shown in FIG. 1.

In FIGS. 1–4, reference numeral 10 designates connector double locking members associated with a second locking member 40. The double locking members 10 include flexible arms 13 having locking protrusions 12 which are formed by cuts 11 in the rear end portion of the double locking members 10 and terminal supporting pieces 14 having a hook 15 at their ends which abuts against a side board 3 of a housing 2.

A recess 5 is formed around inserting holes 4 formed in the side board 3 of the housing 2, and a locking rib 6 protrudes from the recess 5. The hook 15 of the secondary retaining member 40 has a locking hole 16 which is engaged by the locking rib 6. The inserting holes 4 extend through both side boards 3 of the housing and side walls 23 defining the terminal accommodating chambers 7. The recess 5 and the locking ribs 6 are provided around the two openings 8 (i.e., one opening for each of the two locking members 10) of the inserting holes 4. Upon insertion of the double locking members 10 into the inserting holes 4 defined by the side boards 3 of the housing 2 and the side walls 23 of the terminal accommodating chambers 7, the connecting terminal 31 is double-locked in the terminal accommodating chambers 7.

Figure 4:
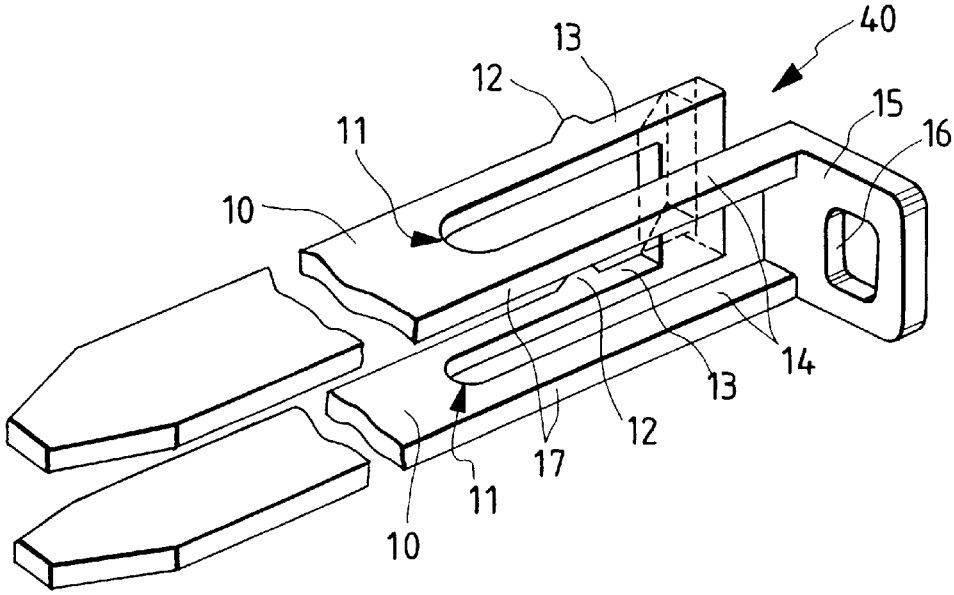
FIG. 4 is a perspective view of double locking members shown in FIG. 1.
Figure 5:
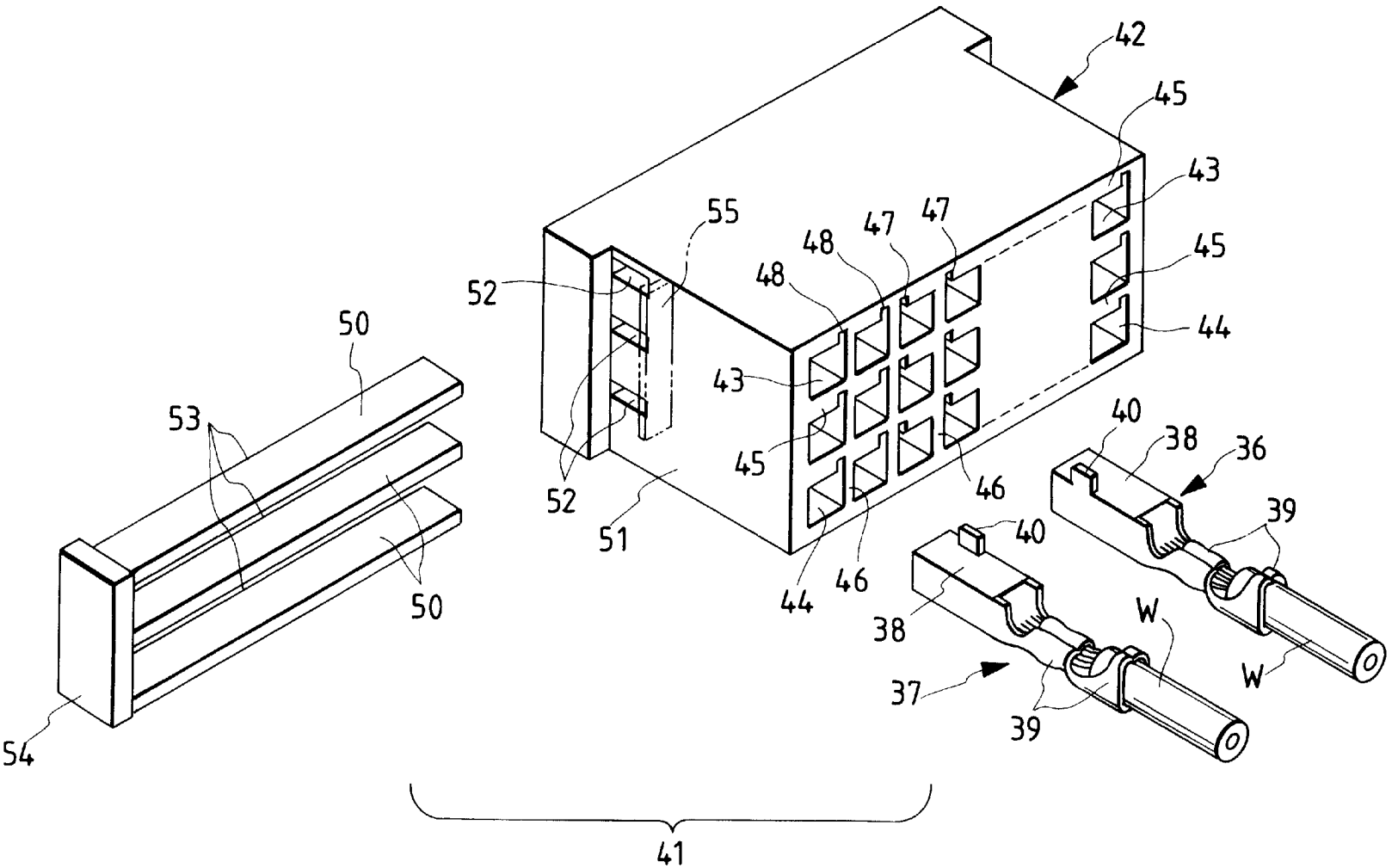
FIG. 5 is an exploded perspective view showing an example of a connector including a conventional double locking member.
Figure 6:
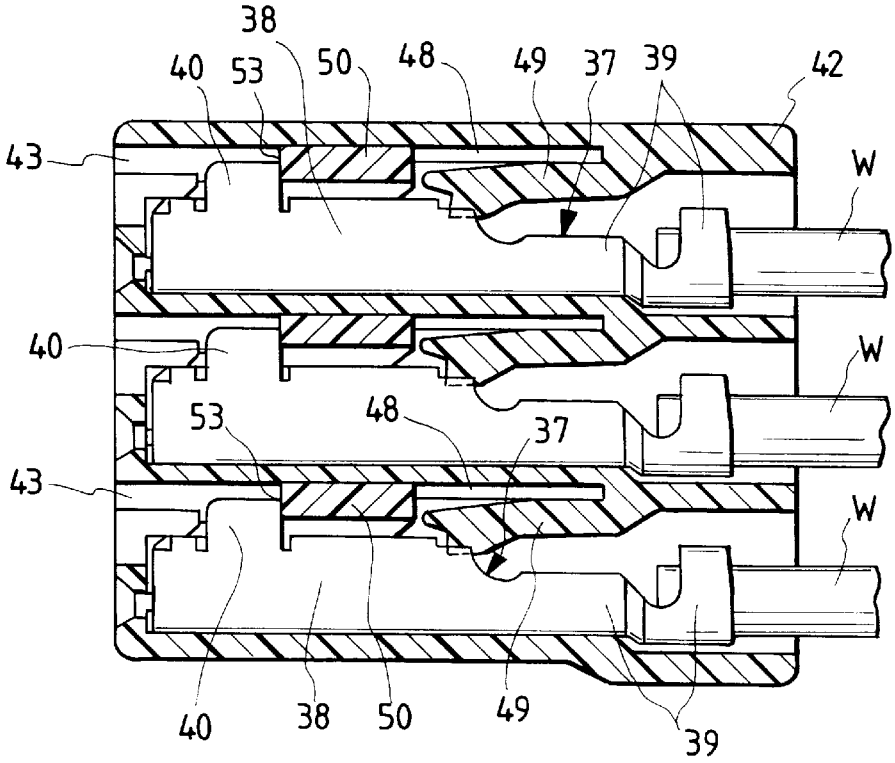
FIG. 6 is a vertical sectional view of the connector including terminal accommodating chambers, which is taken along the axis of the connector.
Figure 7:
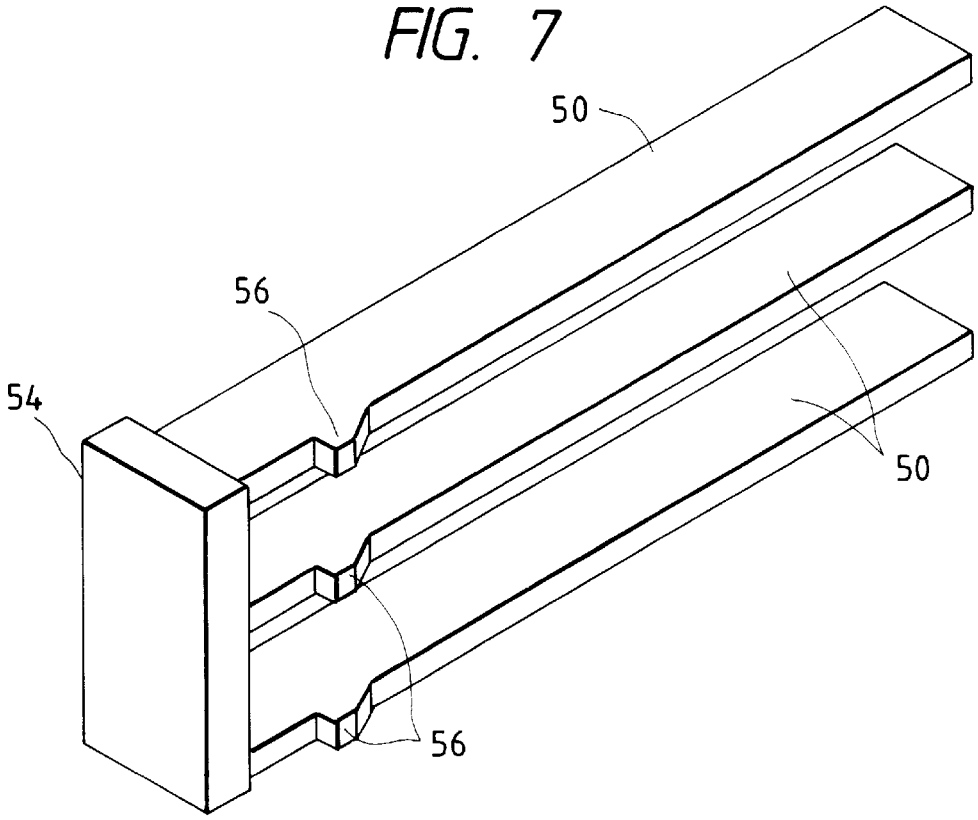
FIG. 7 is a perspective view showing another example of the conventional double locking member.

More specifically, as shown in FIGS. 3 and 4, the connector 1 includes the housing 2 made of synthetic resin and a terminal accommodating chamber into which the connecting terminals 31 are insertable from the rear. Each of the connecting terminals 31 is formed by blanking a metal plate. The front end portion of each terminal is a contact portion 32 into which a mating pin contact (not shown) is insertable so that the pin contact is electrically connected to the terminal, and the rear end portion of the terminal is a crimping portion 33 which fixedly crimps a covered wire W and is electrically connected to its conductor. A locking lance 34 made of a metal plate is provided on the upper surface of the contact portion 32 so that it protrudes obliquely upwardly, and engages a locking protrusion 21 formed in the terminal accommodating chamber 7. Each of the terminal accommodating chambers 7 of the housing 2 is defined by a horizontal wall 22 and the side walls 23.

In order to prevent each of the connecting terminals 31 from being inadvertently withdrawn from the respective terminal accommodating chambers of the housing 2, a first locking member, namely, the locking lance 34 mentioned above, engages the locking protrusion 21 which protrudes from the inner surface of the horizontal wall 22 of the terminal accommodating chamber 7 of the connector 2. In addition, the two locking prongs or double locking members 10 (of the second locking member 40) are respectively inserted into the two inserting holes 4 of the side walls 23. The second locking member 40 is made of an insulating material, and extends in a direction perpendicular to the longitudinal axis of the terminal accommodating chambers. The front end faces of the double locking members 10 of the second locking member 40 are locking faces 17 which abut against the rear ends of the contact portions 32 of the connecting terminals 31.

With the double locking members thus designed, when a particular connecting terminal 31 is inserted into the terminal accommodating chamber 7 of the housing 2, the first locking member, namely, the locking lance 34, engages the locking protrusion 21.

Next, the double locking members 10 of the second locking member 40 are inserted through the inserting holes 4 formed in the side wall 3 of the housing 2 and through the opening 8. In this case, when the locking protrusions 12 pass through the side board 3 (on the insertion side), the flexible arms 13 are bent inwardly, so that the locking protrusions 12 are smoothly locked to the side board 3. In this operation, the locking faces 17 of the double locking members 10 abut against the rear end of the contact portion 32, so that the connecting terminal is double-locked by the double locking members 10.

The above-described first and second locking members are released as follows. The flexible arms 13 and the locking hole 16 are held with a suitable jig so that the flexible arms 13 are bent. As a result, the locking protrusions 12 are released from the side board 3. When, under this condition, the double locking members 10 are pulled sidewardly of the housing 2, then the double locking member 10 are smoothly removed from the housing 2. Next, another suitable jig is inserted into the terminal accommodating chamber 7 from the front to release the locking lance 34 from the locking protrusion 21. Under this condition, the covered wire W is pulled rearwardly until the connecting terminal 31 is removed from the terminal accommodating chamber 7 of the housing 2.

In the above-described embodiment, the double locking members 10 include the flexible arms 13 having the locking protrusions 12 which are formed by the cuts 11 in the rear end portions of the double locking members 10, and the terminal supporting pieces 14 having the hook 15 at their ends which abuts against the side board 3 of the housing 2. Accordingly, the locking protrusions 12 can be retracted by bending the flexible arms 13. Hence, the double locking members 10 can be readily locked to the housing 2 or removed. Furthermore, even if the locking and the removing of the double locking members are repeatedly performed, the relevant members will never be damaged. Hence, the insertion of the double locking members 10 into the housing 2 can be positively and readily achieved, and the resultant connecting-terminal double locking structure is high in reliability.

As noted above, the recess 5 is formed around the inserting holes 4 formed in the side board 3 of the housing 2, the locking rib 6 protrude from the recess 5, and the hook 15 has a locking hole 16. Therefore, the terminal supporting pieces 14 having the hook 15 is locked to the locking rib 6 with the aid of the locking hole 16. Accordingly, the double locking members 10 are positively secured to the housing 2. Further, even when the connecting terminal 31 is pulled outwardly, the double locking members 10 will not be bent; that is, they can positively lock the connecting terminals. Furthermore, since the hook 15 does not protrude from the recess 5 around the inserting holes 4, the double-locking members will not be inadvertently withdrawn when contacted by some other member. Hence, it can be that the resultant connecting-terminal double locking structure is much higher in reliability than the conventional arrangement.

As was described above, the inserting holes 4 extend through the side boards 3 and the side walls 23 of the housing 2, and the recess 5 and the locking rib 6 are provided around each of the openings 8 and 8 (i.e., at opposite sides of the housing) of the inserting holes 4. Therefore, even if an obstacle such as the wall of a vehicle body is near one side board 3 of the housing 2, the double locking members 10 can be inserted into the housing through the openings 8 of the other (opposite) side board 3 of the housing 2. This means that the connector can be arranged with a high degree of freedom.

While there has been described in connection with the preferred embodiment of the invention, the invention is not limited thereto or thereby. That is, it will be obvious to those skilled in the art that various changes and modifications may be made therein without departing from the invention. For instance, in the above-described embodiment, the first locking member, namely, the locking lance 34, is provided on the upper surface of the contact portion 32. However, the invention is not limited thereto or thereby. That is, as in the case of the prior art, the locking lance may be provided on the rear side of the terminal accommodating chamber, to lock the rear end of the contact portion 32. However, in this case, since the second locking member 40, including the double-locking members 10, is positioned on the upper surface of the contact portion 31, a locking protrusion which is locked by the double locking members 10 must be provided on the upper surface of the contact portion 32.

What is claimed is:

1. A double locking member for secondarily retaining terminals in terminal accommodating chambers of a connector housing upon insertion of said double locking member in insertion holes formed in said housing, said double locking member comprising:

a pair of locking prongs extending parallel to each other, one portion of said pair of locking prongs including flexible arms having locking protrusions extending outwardly therefrom and another portion of said locking prongs including terminal retaining pieces, respectively; and a hook member from which said terminal retaining pieces extend substantially perpendicularly therefrom, said hook member being engageable with an exterior portion of said housing to retain said double locking member against said housing in a condition where said terminals are respectively retained by said terminal retaining pieces in said terminal accommodating chambers.

2. The locking member of claim 1, wherein said insertion holes extend perpendicular to said terminal accommodating chambers.

3. The double locking member of claim 1, wherein a side board of said housing including at least one of said insertion holes further includes a recess which circumscribes said at least one of said insertion holes to form countersinks in which said hook member is received such that said hook member does not protrude from said housing.

4. The double locking member of claim 3, wherein said double locking member further comprises a locking rib which extends from an exterior side of said side board of said housing and is engageable with a retaining hole formed in said hook member.

5. A connector, comprising:

a connector housing having a plurality of terminal accommodating chambers for receiving terminals, said housing having a plurality of insertion holes formed in at least one side board of said housing and in side walls of said plurality of terminal accommodating chambers to define an opening extending transversely across said housing and said terminal accommodating chambers; and a double locking member for secondarily retaining terminals provided in said terminal accommodating chambers upon insertion of said double locking member in said opening defined by said plurality of insertion holes, said double locking member including:

a pair of locking prongs extending parallel to each other, said locking prongs including flexible arms having locking protrusions extending outwardly therefrom and terminal retaining pieces, respectively, and a hook member from which said terminal retaining pieces extend substantially perpendicularly therefrom, said hook member being engageable with an exterior side of said at least one side board of said housing to retain said double locking member against said housing in a condition where said terminals are respectively retained by said terminal retaining pieces in said terminal accommodating chambers.

6. The locking member of claim 5, wherein said insertion holes extend perpendicular to said terminal accommodating chambers.

7. The connector of claim 5, wherein said insertion holes are formed at a position corresponding to a rear portion of a contact portion of said terminals, and wherein said terminal retaining pieces inserted through said opening are disposed adjacent to a rear portion of said contact portion, thereby retaining said terminals in place.

8. The connector of claim 5, wherein said plurality of insertion holes are concentrically formed.

9. The double locking member of claim 5, wherein said at least one side board of said housing including at least one of said plurality of insertion holes further includes a recess which circumscribes said at least one of said plurality of insertion holes to form countersinks in which said hook member is received such that said hook member does not protrude from said at least one side board of said housing.

10. The double locking member of claim 9, wherein said double locking member further comprises a locking rib which extends from an exterior side of said side board of said housing and is engageable with a retaining hole formed in said hook member.

11. The connector of claim 9, wherein a second recess is formed in another side board of said housing on an opposite side of said housing than said at least one side board, and wherein said second recess circumscribes an insertion hole formed in said another side board to allow said double locking member to be inserted from said another side board without allowing a hook portion of said double locking member to protrude out of said second recess.

* * * * *